US008459532B2

(12) United States Patent
Stephens

(10) Patent No.: US 8,459,532 B2
(45) Date of Patent: Jun. 11, 2013

(54) FOLDED BOX FOR TRANSPORT OF CYLINDRICAL ARTICLES

(75) Inventor: Kevin Stephens, Birmingham (GB)

(73) Assignee: Deutsche Post AG, Bonn (DE)

( * ) Notice: Subject to any disclaimer, the term of this patent is extended or adjusted under 35 U.S.C. 154(b) by 287 days.

(21) Appl. No.: 12/744,808

(22) PCT Filed: Oct. 30, 2008

(86) PCT No.: PCT/EP2008/009165

§ 371 (c)(1),
(2), (4) Date: Jul. 16, 2010

(87) PCT Pub. No.: WO2009/068149

PCT Pub. Date: Jun. 4, 2009

(65) Prior Publication Data

US 2010/0301107 A1 Dec. 2, 2010

(30) Foreign Application Priority Data

Nov. 26, 2007 (EP) ..... 07022858

(51) Int. Cl.
*B65D 5/08* (2006.01)
*B65D 5/10* (2006.01)

(52) U.S. Cl.
USPC ..... 229/109; 229/122.21; 229/125.19; 229/137; 229/157

(58) Field of Classification Search
USPC ..... 229/109, 132, 136, 920; 206/303, 206/304
See application file for complete search history.

(56) References Cited

U.S. PATENT DOCUMENTS

| | | | | | |
|---|---|---|---|---|---|
| 2,307,076 | A | * | 1/1943 | Ray | 53/449 |
| 2,319,974 | A | * | 5/1943 | Buttery | 229/109 |
| 2,347,422 | A | * | 4/1944 | Loth | 229/109 |
| 2,372,312 | A | * | 3/1945 | Buttery | 229/109 |
| 2,706,592 | A | * | 4/1955 | Schaller | 229/109 |
| 2,819,833 | A | * | 1/1958 | Sauer | 229/109 |
| 3,019,957 | A | * | 2/1962 | Palmer | 229/920 |
| 3,512,697 | A | * | 5/1970 | Robinson | 229/109 |
| 3,520,466 | A | | 7/1970 | Vokes et al. | |
| 3,923,234 | A | * | 12/1975 | Lund, Jr. | 206/586 |
| 4,793,546 | A | | 12/1988 | Nunn | |
| 5,263,633 | A | * | 11/1993 | Bicksler et al. | 229/109 |
| 5,560,539 | A | * | 10/1996 | Baxter | 229/109 |
| 2001/0010327 | A1 | * | 8/2001 | Saulas | 229/109 |

FOREIGN PATENT DOCUMENTS

| | | | | | |
|---|---|---|---|---|---|
| DE | 3839694 | A1 | | 5/1990 | |
| DE | 29612304 | U1 | | 10/1996 | |
| DE | 19705710 | A1 | | 8/1998 | |
| DE | 202007002377 | U1 | | 6/2007 | |
| FR | 2577901 | A1 | * | 8/1986 | 229/109 |
| GB | 2116150 | A | | 9/1983 | |
| GB | 2116150 | A | * | 9/1983 | 229/109 |

* cited by examiner

*Primary Examiner* — Gary Elkins
(74) *Attorney, Agent, or Firm* — International IP Law Group, PLLC

(57) ABSTRACT

A folded box is for transporting cylindrical articles such as tires. The folded box includes two octagonal base planes that are arranged in parallel to each other. At least three rectangular main side planes, that are attached to three outer edges of each octagonal base plane, connect the base planes with each other. At least one hinged cover plane is connected to another outer edge of one of the octagonal base planes.

9 Claims, 6 Drawing Sheets

FOLDED BOX FOR TRANSPORT OF CYLINDRICAL ARTICLES

Figure 1:
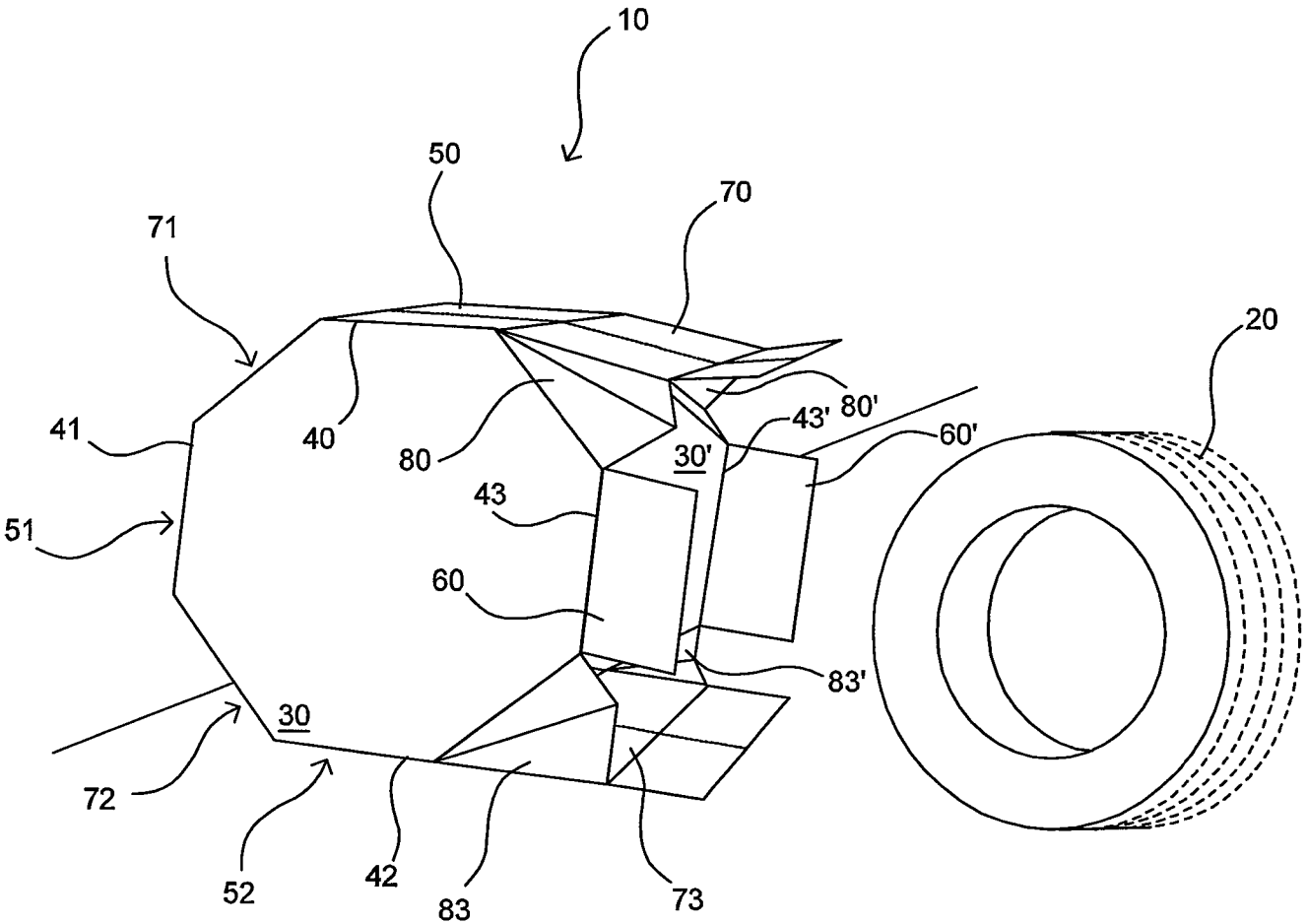

The invention relates to a folded box for transport of cylindrical articles, comprising two octagonal base planes which are arranged in parallel to each other. At least three rectangular main side planes, which are attached to three outer edges of each octagonal base plane connect the base planes with each other, For transport and shipment of cylindrical articles like tyres, wheels or rims it is often necessary to pack the articles in order to protect them against dirt and damage. Furthermore, shipping information has to be attached to the articles, which is often done by sticking labels to the packaging and not to the article itself. Several tyres can be stacked onto a palette, for example, and the palette is wrapped with foil and is shipped to the desired destination. However, when single tyres are to be shipped in the automotive aftermarket, for example, they have to be packed individually. Usually, single tyres are packed by using a cling wrap. This is disadvantageous, because such packaging adheres to conveyer belts causing blockages and delays within the distribution network. Therefore, cardboard packagings can be used.

German Utility Model No. DE 20 2007 002 377 U1 discloses a packaging made of cardboard for cylindrical articles like tyres which comprises a stripe with a plurality of flaps on both sides. The cardboard stripe is wrapped around the tyre tread and its ends are connected. The flaps are folded on both sides in order to form a cylindrical packaging, whereby the flaps are connected to each other.

German Patent Application No. DE 38 39 694 A1 describes a folded box for articles like light alloy rims which is made from cardboard. The folded box is made from a single pre-cut cardboard that comprises an octagonal base plane the size of a rim. Several rectangular side parts are connected to the octagonal base which can be folded upwards for forming the frame of the box. Preferably, the side parts are folded twice in order to form a strong cardboard frame. One or more alloy rims can be placed in such folded box and several boxes are stacked onto each other. Then, the stack of boxes is wrapped by another cardboard material and the package is wound with stripes.

The objective of the invention is to provide a packaging for cylindrical articles like tyres, rims and wheels, which allows easy and secure transport of such articles. The packaging should be made from pre-cut cardboard that can easily be assembled.

According to the invention, this objective is achieved by a folded box having the features of the independent claim 1. Advantageous refinements of the box are set forth in the subordinate claims 2 through 20.

The folded box according to the invention comprises two octagonal base planes which are arranged in parallel to each other, whereby at least three rectangular main side planes, which are attached to three outer edges of each octagonal base plane, connect the base planes with each other. At least one hinged cover plane is connected to another outer edge of one of said octagonal base planes. In one embodiment of the invention, a hinged cover plane is connected to an outer edge of each octagonal base plane, respectively.

Preferably, the main side planes are attached to every second outer edge of each base plane, whereby three adjacent outer edges of each base plane are not connected to a main side plane, and the at least one hinged cover plane is attached to the middle edge of these adjacent outer edges.

Four rectangular supplementary side planes can be attached to the edges of two opposite rectangular main side planes, whereby said supplementary side planes are attached to that edges of said opposite main side planes that are not connected to the octagonal base planes.

Furthermore, eight fan-shaped connecting planes can be arranged between the supplementary side planes and those outer edges of the octagonal base planes that are not connected to a main side plane or a hinged cover plane. Preferably, each fan-shaped connecting plane comprises two triangular fan planes, which are separated by a crease line. Thereby, each fan-shaped connecting plane can be folded into the inside of the folded box. Preferably, a circular relief hole is located at the sharp end of each fan-shaped connecting plane.

In a further embodiment of the invention, eight reinforcing planes are attached to those dada outer edges of the octagonal base planes that are not connected to main side planes or the at least one hinged cover plane, whereby the reinforcing planes are folded into the inside of the folded box and they are arranged underneath the supplementary side planes.

In one embodiment of the invention, the folded box consists of two identical pre-cut cardboards each comprising an octagonal base plane, and three rectangular main side parts, which are attached to three outer edges of each octagonal base plane, and at least one hinged cover part that is connected to another outer edge of the octagonal base planes, whereby the two pre-cut cardboards are connected to each other, and two opposite main side parts of each pre-cut cardboard form the main side planes of the folded box, respectively.

At least the main side parts of each pre-cut cardboard are glued and/or stapled to each other, thereby connecting the two pre-cut cardboards. The three main side parts of each pre-cut cardboard can also be connected by slots and tabs, thereby connecting the two pre-cut cardboards.

In a further embodiment of the invention, the folded box consists of one pre-cut cardboard that comprises two octagonal base planes that are connected at an outer edge of each base plane by a rectangular main side plane, whereby two further rectangular side parts and a hinged cover part are connected to three other outer edges of each base plane, respectively, whereby the two further rectangular side parts of a base plane are connected to the two further rectangular side parts of the opposite base plane, and these rectangular side parts form the main side planes of the folded box, respectively.

In a further embodiment of the invention, the folded box consists of one pre-cut cardboard that comprises two octagonal base planes that are connected at an outer edge of each base plane by a rectangular main side plane, whereby two further rectangular side parts and a hinged cover part are connected to three other outer edges of each base plane, respectively, whereby a further rectangular side part of a base plane is connected to a further rectangular side part of the opposite base plane thereby forming a first main side plane of the folded box, and a further rectangular side part of a base plane is connected to a further rectangular side part of the opposite base plane thereby forming a second main side plane of the folded box.

Preferably, the rectangular side part of the base plane is a glue flap which is glued to the rectangular side part of the base plane.

In another embodiment of the invention, the rectangular side part of the first base plane and the rectangular side part of the second base plane comprise lateral locking tabs which engage with slots in the supplementary side planes. The cover parts can also comprise lateral locking tabs which engage with slots in the supplementary side planes.

The advantage of the folded box according to the invention lies in the easy but secure packaging of cylindrical articles like tyres. The packaging can be handled in every kind of transport or shipment process without damage to the packed article or the devices involved. Shipping labels with barcodes can easily be attached to the box and a tyre can be handled like any other parcel or small container.

Furthermore, the folded box can be used several times and can be folded and stacked after use. When the box is needed again, it can be reassembled in a very easy. The octagonal shape of the box avoids damage to corners of the box as it usually occurs when rectangular boxes are used for transport of cylindrical articles.

Additional advantages, special features and practical refinements of the invention can be gleaned from the subordinate claims and from the presentation below of preferred embodiments making reference to the figures.

Figure 2:
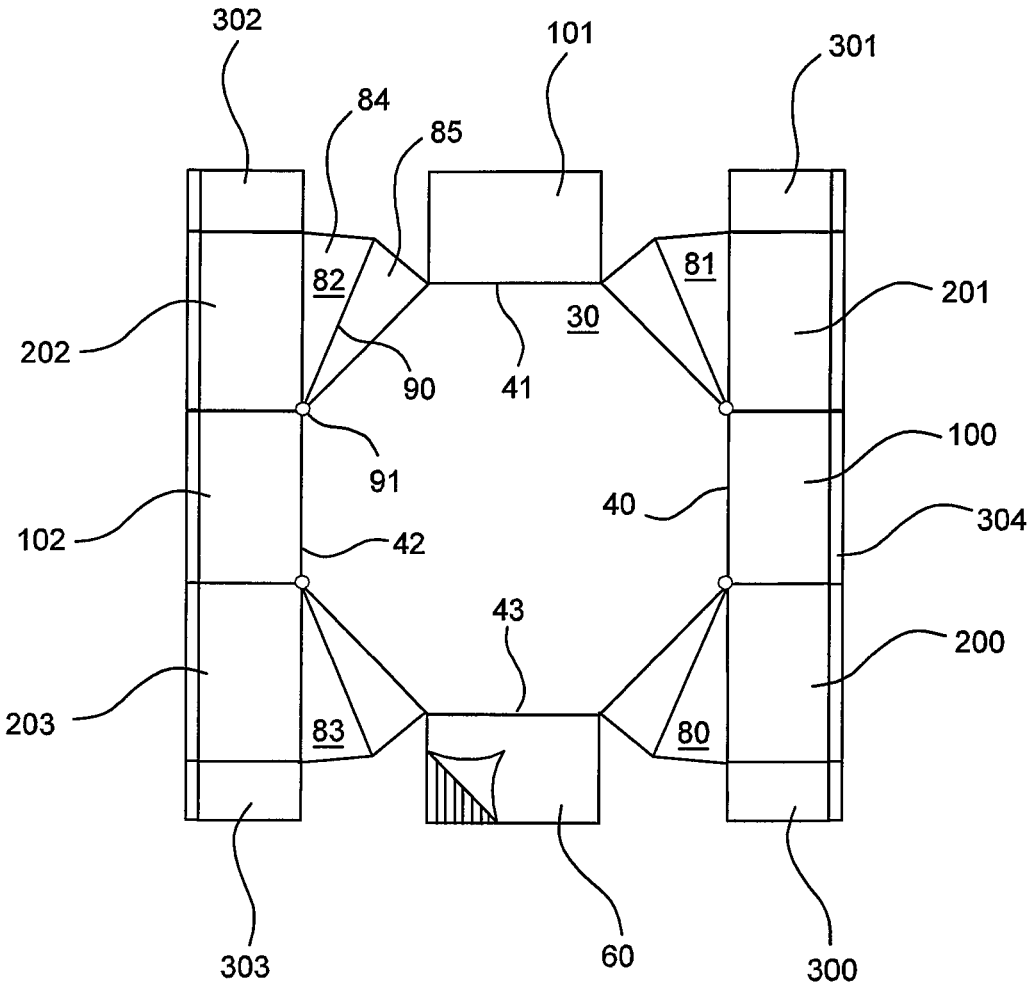
Figure 3:
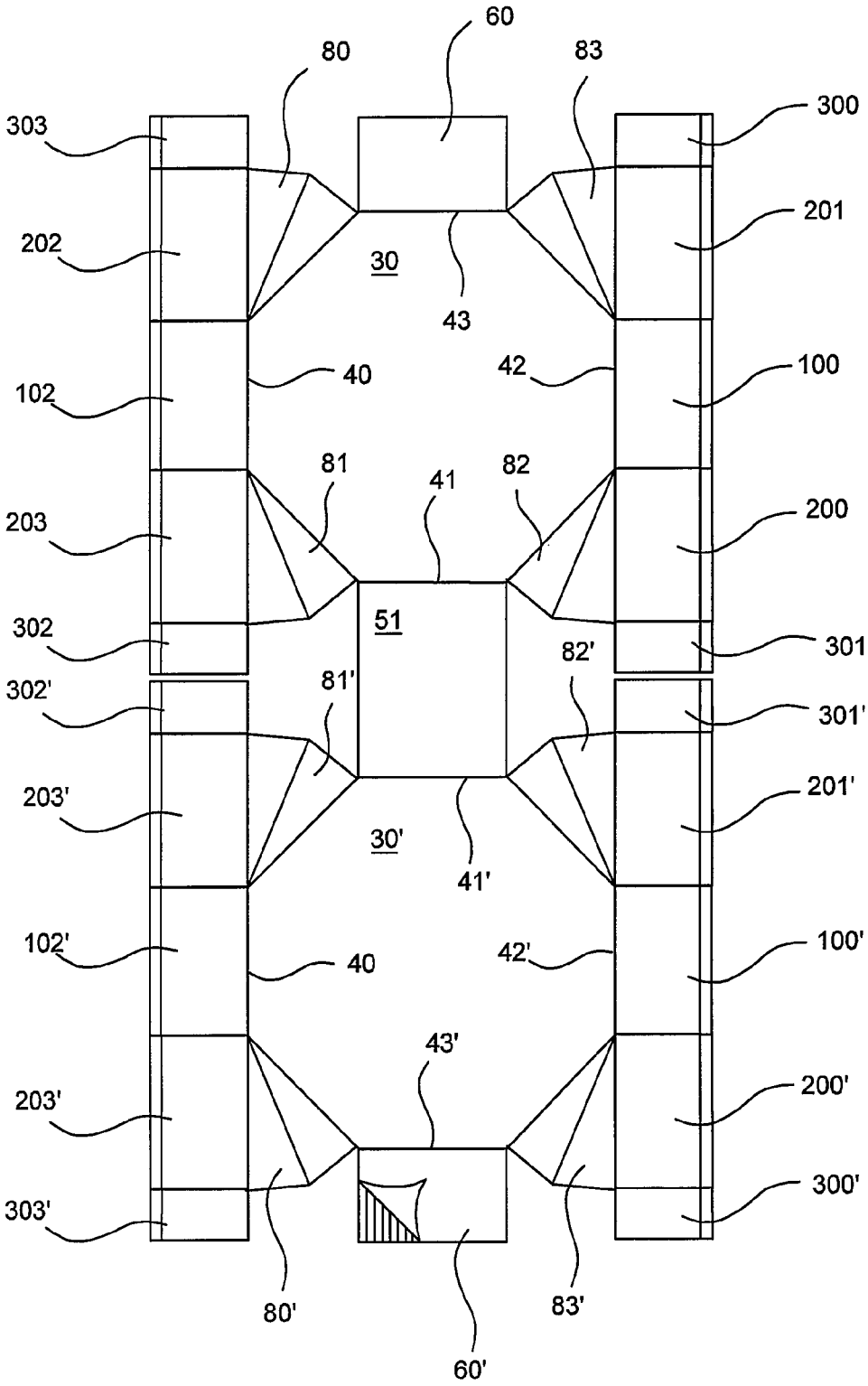
Figure 4:
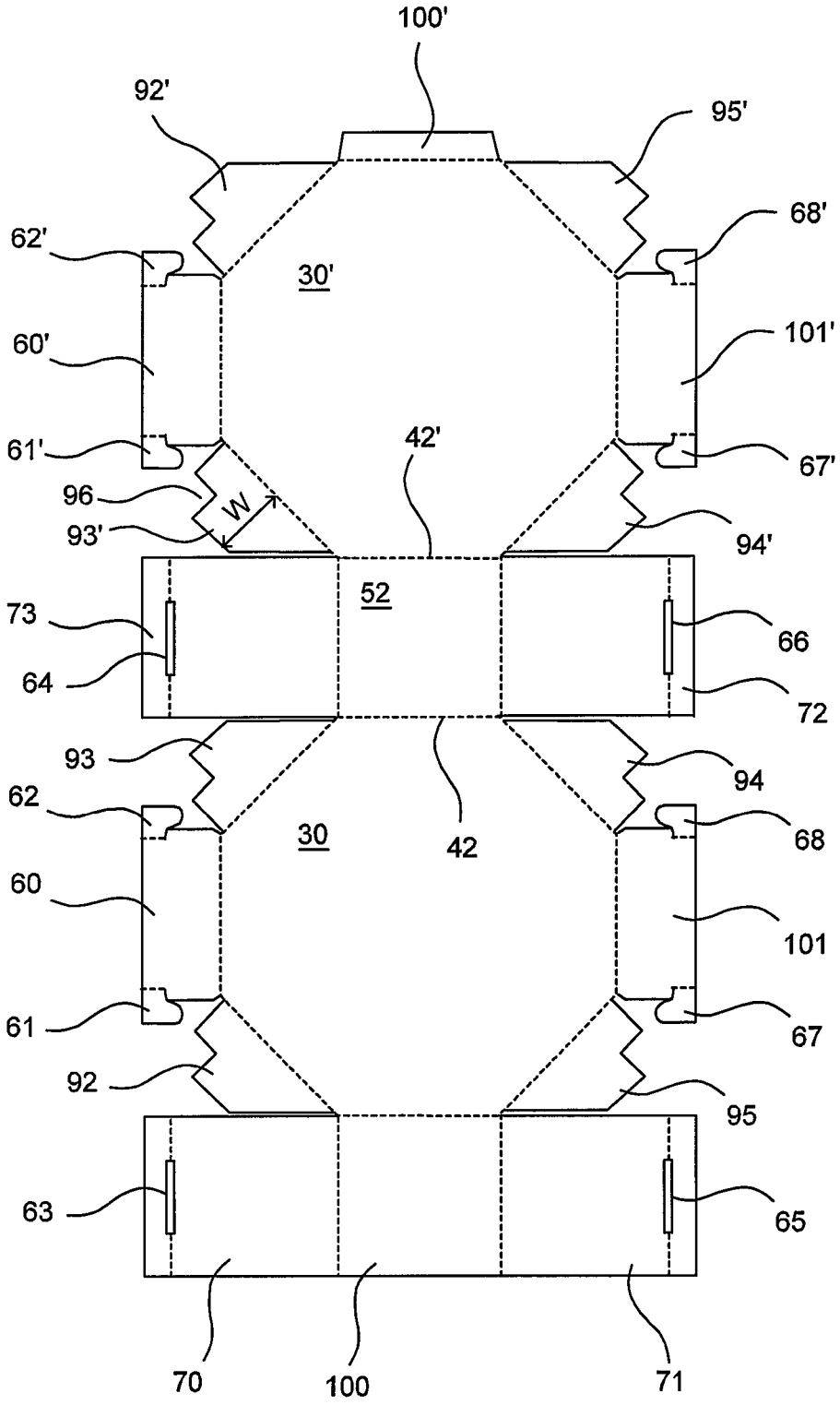
Figure 5:
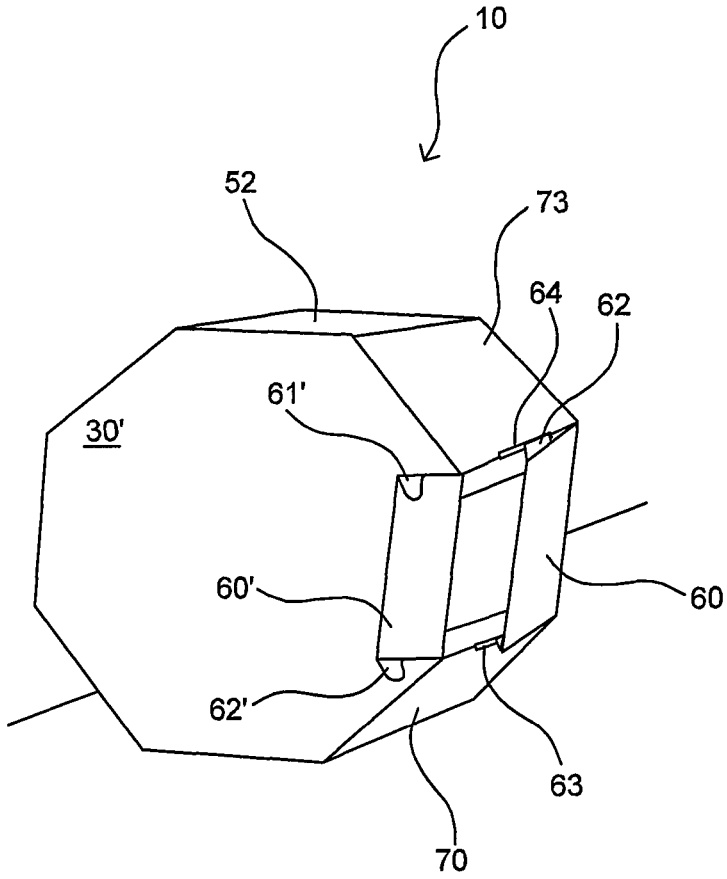

The figures show the following:

FIG. 1 a side view of one embodiment of a folded box;

FIG. 2 an embodiment of one of two identical pre-cut cardboards for assembly of a folded box;

FIG. 3 an embodiment of a single pre-cut cardboard for assembly of a folded box;

FIG. 4 a second embodiment of the invention with locking tabs and reinforcing planes;

FIG. 5 a side view of the folded box of FIG. 4; and

Figure 6:
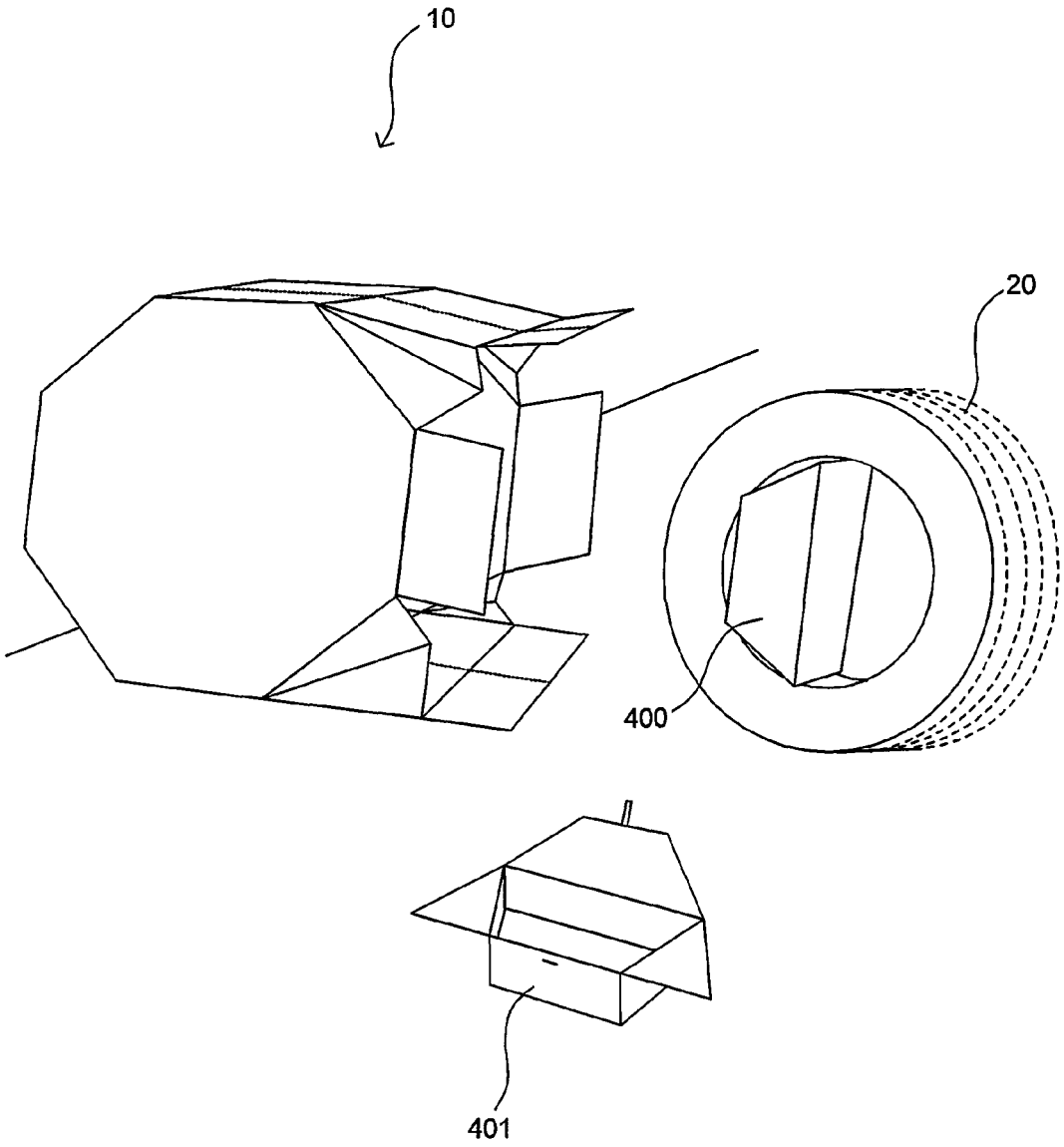

FIG. 6 an embodiment of the invention with two inner boxes.

FIG. 1 shows a preferred embodiment of the folded box according to the invention. The folded box 10 can receive a cylindrical article like a tyre, wheel or rim, for example. However, the invention is not limited to the packaging and shipment of automotive articles, because any cylindrical article can be transported with the box in a very safe and convenient way. The folded box is very easy to assemble and provides for safe transport of an article.

In the following, the folded box 10 will be described with the shipment of a tyre 20. Preferably, a single tyre 20 is brought into the folded box 10. If thinner articles are shipped, two articles can be placed in the box next to each other. Therefore, the folded box offers various possibilities for packaging of cylindrical articles.

The folded box 10 comprises two octagonal base planes 30 and 30' which are arranged in parallel to each other. The inner diameter of the octagonal base planes is about the size of the article to be transported. For transport of a tyre the inner diameter of the base planes is about 660 mm, for example. Preferably, different folded boxes are designed for different articles or different sizes of articles, respectively. For example, folded boxes for the shipment of rims can be smaller than boxes for transport of tyres. On the other hand, the size of a folded box does have to be adjusted to every possible diameter and width of a tyre. If an article does not fill out the folded box, cushions can be inserted in the free space.

The folded box 10 further comprises three rectangular main side planes 50, 51 and 52, which are attached to three outer edges 40, 41, 42, 40', 41' and 42' of each octagonal base plane, respectively. These main side planes connect the octagonal base planes 30 and 30' with each other. Furthermore, at least one hinged cover plane is connected to another outer edge of one of said octagonal base planes 30 and 30'. Thereby, a first cover part 60 can be connected to a first outer edge 43, and a second cover part 60' can be connected to a second outer edge 43'. When both cover parts are folded inwards, they form a cover plane that closes the remaining opening on one side of the folded box 10. These cover parts 60 and 60' can be glued together or can be connected by an adhesive tape, for example.

In another embodiment of the invention, only one cover plane is connected to one outer edge of a first base plane 30 and when the cover plane is folded inwards, it closes the remaining opening of the folded box 10. In this case, the cover plane can be connected to the opposite outer edge of the opposite base plane 30' by use of an adhesive tape, too. In order to facilitate the fixing, the cover plane can comprise one or more tabs which are separated from the cover plane by a folded lines. The tabs can be folded inwards and can be connected to the opposite base plane 30', thereby providing a sufficient surface for a fixing. The cover plane or cover parts can also comprise one or more locking tabs that can be inserted into slots in the opposite cover part or the opposite base plane, respectively.

In one embodiment of the invention, the main side planes 50, 51 and 52 are attached to every second outer edge of each base plane 30 and 30', whereby three adjacent outer edges of each base plane are not connected to a main side plane. In that case, the at least one hinged cover plane is attached to the middle edge of these remaining adjacent outer edges. Thereby, the main side planes and a cover plane are connected to every second outer edge of the base plane 30 and 30'. Preferably, the width of the main side planes 50, 51 and 52 corresponds to the width of the article to be transported. In case of a tyre 20, the width lies between 10-40 cm, for example. In a preferred embodiment, the width of the main side planes is about 240 mm. The main side planes 50, 51 and 52 can be arranged at the outer edges of the octagonal base planes in various manners, but the configuration according to FIG. 1 provides for a very stiff and strong box. If the main side planes and the cover plane (parts) are arranged at every second outer edge of the octagonal base planes, as shown in FIG. 1, no further side planes have to be provided for transport of small and light articles, for example.

However, when tyres are transported further side planes should be provided in order to increase the stability of the folded box. For that purpose, four rectangular supplementary side planes 70, 71, 72 and 73 can be attached to the edges of two opposite rectangular main side planes 50 and 52, whereby said supplementary side planes are attached to that edges of said opposite main side planes 50 and 52 that are not connected to the octagonal base planes 30 and 30'. These supplementary side planes 70, 71, 72 and 73 cover the remaining openings of the folded box. The supplementary side planes are separated from the main side planes 50 and 52 by folded lines and can thus be folded in order to form an outer surface for the folded box which then has an octagonal profile. Preferably, fixing stripes 300, 301, 302 and 303 provided with a folded line are located opposite to the fold of each main side plane, as can be gleaned from FIG. 2. The fixing stripes 300, 301, 302 and 303 can also be folded inwards and can be connected to the adjacent main side plane 51, which is formed by two main side parts by use of glue and/or an adhesive tape, for example. They can be connected by a fixing comprising tabs and slots, too.

In order to give the folded box 10 even more stability and to close gaps between the side planes and the base planes eight fan-shaped connecting planes 80, 81, 82, 83, 80', 81', 82' and 83' can be arranged between the supplementary side planes 70, 71, 72, 73 and those outer edges of the octagonal base planes 30 and 30' that are not connected to the main side planes 50, 51 and 52 and the hinged cover parts 60 and 60'. This arrangement can be gleaned from FIG. 2. Preferably, each fan-shaped connecting plane comprises at least two triangular fan planes 84 and 85, which are separated by a crease line 90. When the box 10 is assembled each fan-shaped connecting plane is folded into the inside of the folded box 10 at its crease line 90. A circular relief hole 91 is located at the sharp end of each fan-shaped connecting plane 80, 81, 82, 83, 80', 81', 82' and 83' for easier folding of the components of the box 10.

The folded box 10 can be assembled in different ways. In a first embodiment of the invention, the folded box consists of two identical pre-cut cardboards that are connected to each other. Such pre-cut cardboard is shown in FIG. 2, whereby a single pre-cut cardboard will be described with respect to FIG. 2. Two pre-cut cardboards form a box and thereby, main side planes 50, 51 and 52 and supplementary side planes 70, 71, 72 and 73 of the final box are divided into two opposite parts arranged at each pre-cut cardboard, whereby two opposite main side parts of each pre-cut cardboard form the main side planes 50, 51 and 52 of the folded box, for example. Two supplementary side parts form the supplementary side planes 70, 71, 72 and 73, respectively. Preferably, the direction of fluting in the cardboard material of the folded box is chosen as shown in FIG. 2.

Each pre-cut cardboard comprises an octagonal base plane 30 and three rectangular main side parts 100, 101 and 102, which are attached to three outer edges 40, 41 and 42 of the octagonal base plane 30. A hinged cover part 60 is connected to another outer edge 43 of the octagonal base plane 30. The main side parts and the hinged cover part are arranged at every second outer edge of the base plane. Four rectangular supplementary side parts 200, 201, 202 and 203 are connected to each side of two opposite main side parts 100 and 102 via folds. Four fan-shaped connecting planes 80, 81, 82 and 83 are arranged between these supplementary side parts 200, 201, 202 and 203 and the base plane 30. The fan-shaped connecting planes are designed as described above for the folded box. They each comprise at least two triangular fan planes 84 and 85, a crease line 90 and a relief hole 91.

Preferably, fixing stripes 300, 301, 302 and 303 are located at the supplementary side parts 200, 201, 202 and 203. Fixing stripes 301 and 302 can be used for fixing the supplementary side parts 201 and 202 with the main side part 101, for example. This connection will be established when the folded box 10 is assembled. The fixing stripes 300 and 303 on the side of the cover part 60 can be fixed to the cover parts 60 and 60' of each pre-cut cardboard after the tyre 20 has been placed in the folded box.

Preferably, at least the main side parts 100 and 102, the supplementary side parts 200, 201, 202 and 203 and the fixing stripes 300, 301, 302 and 303 each comprise glue edges for connection with other components. Alternatively or in addition to an adhesive fixing, the parts can be stapled to each other. One of these glue edges is indicated with reference numeral 304 in FIG. 2. The two pre-cut cardboards can be connected to each other via these stripes that are glued onto each other. Preferably, there is no fold between the respective side part and a glue edge. When the main side parts 100 and 102, the supplementary side parts 200, 201, 202 and 203 and the fixing stripes 300, 301, 302 and 303 of one pre-cut cardboard have been glued to their corresponding parts of another pre-cut cardboard, these parts form the respective planes of the box. After connection of the two pre-cut cardboards, the box can be folded and erected.

The assembly of two pre-cut cardboards can be folded via a line running through the outer edge 42 of the base plane 30 of the first pre-cut cardboard and a line running through the outer edge 40' of the base plane 30' of the second pre-cut cardboard, for example. Thereby, a flat box kit can be provided. Several of these flat box kits can be bought by a customer who whishes to ship one or more tyres. The two pre-cut cardboards can be folded via the glued edges 304, too, if corresponding folds are provided. However, when the cardboards are folded at the glued edges, the outer surface of the folded box will tend to bend, which might be disadvantageous.

A person will unfold the box kit consisting of two identical pre-cut cardboards and will fix the fixing stripes 301 and 302 with the main side plane 101 of each cardboard. The cover parts 60 and 60', the supplementary side parts 200, 203, 200' and 203' and the fan-shaped connecting planes 80, 83, 80' and 83' are bent outwards in order to form a wide opening as can be gleaned form FIG. 1. The tyre 20 can be rolled into the folded box 10. Then, the named parts are bent inwards and the cover parts 60 and 60' and the fixing stripes 300 and 303 can be folded onto each other in order to form a complete cover for the box. The cover can be fixed by means of an adhesive tape, for example. In another embodiment of the invention, the cover parts 60 and 60', the supplementary side parts 200, 203, 200' and 203' and the fan-shaped connecting planes 80, 83, 80' and 83' comprise tabs and/or slots, respectively. The tabs are inserted into the slots and, additionally, the cover is fixed by means of an adhesive tape.

In another embodiment of the invention, the folded box consists of one pre-cut cardboard which is shown in FIG. 3. The cardboard basically comprises similar parts as the single cardboards of FIG. 2. However, when two of these cardboards are combined, two main side parts 101 form the main side plane 51 of the final folded box. The supplementary side parts and the fan-shaped connecting parts and all glue edges correspond to the embodiment of FIG. 1. The cardboard can be cut from continuous cardboard material and then folds, crease lines and relief holes can be produced in any method known to a person skilled in the art. In addition to the folds and cuts required for two single pre-cut cardboards, in a single pre-cut cardboard a cut has to be provided between the fixing stripes 301 and 301' and 302 and 302, respectively. The different parts of the cardboard are connected to each other as described for the embodiment of FIG. 2.

Another embodiment of the invention is shown in FIG. 4, where dotted lines are crease or fold lines, whereas solid lines show cut lines. In this embodiment, two octagonal base planes 30 and 30' are connected by a main side plane 52 at outer edges 42 and 42'. Further main side parts 100 and 100' are connected to base planes 30 and 30' at outer edges opposite to edges 42 and 42'. When the box is folded, main side parts 100 and 100' form the main side plane 50. In the embodiment of FIG. 4, main side part 100' is a thin glue flap. In that case, main side part 100 will form the main side plane 50 and the main side part 100 is glued to the glue flap 100'. Four supplementary side planes 70, 71, 72 and 73 are attached to the main side parts/planes 52 and 100, respectively. Each supplementary plane comprises a slot 63, 64, 65 and 66 in its outer region, respectively. Two cover parts 60 and 60' and two side parts 101 and 101' comprise lateral locking tabs 61, 62, 61', 62', 67, 68, 67' and 68', respectively, which can be engaged with the slots of the supplementary planes when the box is folded. The locking tabs can have fold lines for easy bending inwards. Thereby, the side parts 101 and 101' form the backmost side plane 51 of the folded box 10 when they are engaged with each other. The cover parts 60 and 60' can be engaged with the supplementary planes after the tyre has been placed in the folded box. With these locking tabs and slots no additional sticking tape is required.

The engagement of the locking tabs of the cover parts 60 and 60' with the slots 63 and 64 of the supplementary planes 70 and 73 is shown in FIG. 5. The backmost main side plain 51 was formed by connecting the side parts 101 and 101' in the same manner. When the cover parts and side parts are connected, an optional sticking tape can be applied or the whole folded box is tied with a band, for example. In FIG. 1, the box is closed by cover parts 60 and 60' which are folded over the remaining opening of the box from above and below. In contrast to the embodiment of FIG. 1, the box is now closed by cover parts 60 and 60' which are folded over the opening of the box from the left and right hand. The supplementary side planes 70 and 73 can be wide opened for rolling an article in the folded box, for example, and when the article is placed in the box, the supplementary side planes 70 and 73 can be folded inwards and the remaining opening is closed by connecting the cover parts 60 and 60' by inserting the locking tabs 61, 62, 61' and 62' into the slots 63 and 64 of the supplementary side planes.

Each octagonal base plane can comprise four reinforcing planes 92, 93, 94, 95 and 92', 93', 94' and 95, respectively. These reinforcing planes are connected to those outer edges of the base planes that are not connected to cover parts or side parts. Preferably, they are connected to every second edge of the base planes. In contrast to the embodiment shown in FIG. 2, the edges of the reinforcing planes are not connected to the supplementary planes 70,71, 72 or 73, the cover parts 60 or 60' and the side parts 101 or 101'. Therefore, they can be folded into the inside of the box via fold lines and will be arranged underneath the supplementary planes when the box 10 is erected.

The reinforcing planes can have various shapes in order to fulfil their function of closing the gap between the supplementary planes and the cover parts 60 or 60' and side parts 101 or 101', respectively. Furthermore, they are supposed to reinforce the main side planes. When they are folded inwards they should not interfere with each other or the locking flaps of the cover parts 60 or 60' and side parts 101 or 101'. In the embodiment of FIG. 4, this is achieved by reinforcing planes with a width W that is about half the width of the supplementary planes. Thereby, the reinforcing planes can be arranged underneath the supplementary planes without overlapping each other. Furthermore, the reinforcing planes can have a round or rectangular recess 96 that allows the locking flaps to engage with the slots of the supplementary planes.

In the embodiment of FIG. 4, the folded box 10 consists of a single pre-cut cardboard. In an alternative embodiment which is not shown in the figures, this box with reinforcing planes 92, 93, 94, 95, 92', 93', 94' and 95 can also consist of two identical pre-cut cardboards which are connected at the main side parts and supplementary side parts, for example. Furthermore, these two pre-cut cardboards can comprise locking tabs and slots or adhesive tapes can be used for connecting the corresponding parts with each other. Locking tabs and slots can also be provided in the embodiments of FIGS. 2 and 3. Therefore, any combination of features shown in the figures can be chosen for a folded box depending on the requirements for packaging a specific article.

FIG. 6 shows another possible application of the folded box 10. Thereby, one or two smaller inner boxes 400 and 401 can be inserted into the interior space of a tyre 20. Additional parts and/or literature can be placed in these smaller boxes. The boxes can have any shape that fits into the interior space of the tyre 20. However, it has proven to be advantageous to use two identical boxes that form a hexagonal body when they are put together. Additional parts can be placed in the inner boxes and the inner boxes are brought into the interior space of the tyre. Then, the tyre is placed in the box 10 and the box is closed as described above.

LIST OF REFERENCE NUMERALS 10 box, packaging
20 cylindrical article, tyre, rim, wheel
30,30' base plane
40,41,42,43, 40',41',42',43' outer edge of base plane
50,51,52 main side plane
60,60' cover plane, cover part
61,62,61',62',67,68,67',68' locking tab
63,64,65,66 slot
70,71,72,73 supplementary side plane
80,81,82,83, 80',81',82',83' fan-shaped connecting plane
84,85 fan plane
90 crease line
91 relief hole
92,93,94,95,92',93',94',95' reinforcing plane
96 recess
100,101,102,102' main side part
200,201,202,203,200',201',202',203' supplementary side parts
300,301,302,303,300',301',302',303' fixing stripe
304 glue edge
400,401 inner box

The invention claimed is:

1. A folded box (10) for transport of cylindrical articles (20), comprising two octagonal base planes (30;30') which are arranged in parallel to each other, wherein at least three rectangular main side planes (52;100; 101, 101'), which are attached to three outer edges (40;41;42; 40';41';42') of each octagonal base plane (30;30'), connect the base planes (30; 30') with each other, wherein at least one hinged cover plane (60;60') is connected to another outer edge (43;43') of one of the octagonal base planes (30;30'), and wherein four rectangular supplementary side planes (70, 71, 72, 73) are attached to edges of two of the rectangular main side planes (52, 100), wherein the supplementary side planes (70, 71, 72, 73) are attached to the edges of two main side planes (52, 100) that are not connected to the octagonal base planes (30; 30') and eight reinforcing planes (92, 93 94, 95, 92', 93', 94', 95') are attached to the outer edges of the octagonal base planes (30, 30') that are not connected to the three rectangular main side planes (50, 51, 52) or the at least one hinged cover plane (60;60',101, 101'), wherein the eight reinforcing planes (92; 93;94;95;92';93';94';95') are folded into an inside of the folded box (10) and are arranged underneath the four rectangular supplementary side planes (70, 71, 72, 73), wherein the at least one hinged cover part (60;60') and one of the three rectangular main side planes (101, 101') comprise lateral locking tabs (61, 62, 61', 62', 67, 68, 67', 68') to engage in slots (63, 64, 65, 66) in the four rectangular supplementary side planes (70, 71, 72, 73).

2. The folded box according to claim 1, wherein a hinged cover plane (60;60') is connected to an outer edge (43;43') of each octagonal base plane (30;30'), respectively.

3. The folded box according to claim 1, wherein the at least three rectangular main side planes (52;100; 101) are attached to every second outer edge of each base plane (30;30'), wherein three adjacent outer edges of each base plane (30;30') are not connected to a main side plane (52;100; 101), and the at least one hinged cover plane (60;60') is attached to a middle edge of the three adjacent outer edges.

4. The folded box according to claim 1, wherein the material of the folded box (10) comprises cardboard.

5. The folded box according to claim 1, wherein the folded box comprises one pre-cut cardboard that comprises two octagonal base planes (30;30') that are connected at an outer edge (41;41') of each base plane (30;30') by a rectangular main side plane (52, 100), wherein one further rectangular side part (101; 101') and a hinged cover part (60;60') are connected to two other outer edges of each base plane (30; 30'), respectively, wherein the one further rectangular side part (101) of a base plane (30) is connected to one further rectangular side part (101';102') of an opposite base plane (30'), and wherein the rectangular main side plane, the one further rectangular side part of the base plane, and the one further rectangular side part of the opposite base plane (101; 101') form the at least three rectangular main side planes (51) of the folded box, respectively.

6. The folded box according to claim 1, wherein the reinforcing planes (92, 93, 94, 95, 92', 93', 94', 95') comprise a recess (96).

7. A folded box (10) for transport of cylindrical articles (20), comprising two octagonal base planes (30;30') which are arranged in parallel to each other, wherein at least three rectangular main side planes (52;100; 101, 101'), which are attached to three outer edges (40;41;42; 40';41';42') of each octagonal base plane (30;30'), connect the octagonal base planes (30;30') with each other, wherein at least one hinged cover plane (60;60') is connected to another outer edge (43; 43') of one of the octagonal base planes (30;30') comprising one pre-cut cardboard comprising two octagonal base planes (30; 30') that are connected at an outer edge (42; 42') of each of the octagonal base planes (30; 30') by a rectangular main side plane (52), wherein two further rectangular side parts (100; 100'; 101; 101') and a hinged cover part (60; 60') are connected to three other outer edges of each base plane (30; 30'), respectively, wherein a further rectangular side part (100) of a base plane (30') is connected to a second further rectangular side part (100') of an opposite base plane (30'), forming a main side plane of the folded box, and wherein the cover parts (60; 60') comprise lateral locking tabs (67; 68; 67'; 68') which engage with slots (63; 64) in the supplementary side planes (70; 71; 72; 73).

8. A folded box (10) for transport of cylindrical articles (20), comprising two octagonal base planes (30;30') which are arranged in parallel to each other, wherein at least three rectangular main side planes (52;100, 101, 101'), which are attached to three outer edges (40;41;42; 40';41';42') of each octagonal base plane (30;30'), connect the octagonal base planes (30;30') with each other, wherein at least one hinged cover plane (60;60') is connected to another outer edge (43; 43') of one of the octagonal base planes (30;30'), and wherein four rectangular supplementary side planes (70, 71, 72, 73) are attached to edges of two of the rectangular main side planes (52, 100), wherein the rectangular supplementary side planes (70, 71, 72, 73) are attached to the edges of two rectangular main side planes (52, 100) that are not connected to the octagonal base planes (30; 30') and eight reinforcing planes (92, 93 94, 95, 92', 93', 94', 95') are attached to outer edges of the octagonal base planes (30, 30') that are not connected to rectangular main side planes (50, 51, 52) or the at least one hinged cover part (60;60',101, 101'), wherein the reinforcing planes (92;93;94;95;92';93';94';95') are folded inside of the folded box (10) and are arranged underneath the supplementary side planes (70, 71, 72, 73), wherein the at least one hinged cover part (60;60') and one of the rectangular main side planes (101, 101') comprise lateral locking tabs (61, 62, 61', 62', 67, 68, 67', 68') wherein the reinforcing planes (92;93;94;95;92';93'; 94';95') comprise a recess (96) in order to allow the locking tabs (61: 62;61';62';67; 68;67';68') to engage in slots (63;64;65;66) in the supplementary side planes (70, 71, 72, 73) without overlapping with the reinforcing planes (92;93;94;95;92';93'; 94';95').

9. A folded box according to claim 8, wherein the reinforcing planes (92;93;94;95;92';93'; 94';95') comprise a shape comprising a width approaching half a width of the supplementary side planes (70;71;72;73) to allow an arrangement of the reinforcing planes.

* * * * *